United States Patent [19]

Otten et al.

[11] 4,145,815

[45] Mar. 27, 1979

[54] CARRIAGE DRAWING MACHINE

[75] Inventors: Heinrich Otten; Hans Eder; Rolf Plöger, all of Wilhelmshaven, Fed. Rep. of Germany

[73] Assignee: Franz Kuhlmann KG., Wilhelmshaven, Fed. Rep. of Germany

[21] Appl. No.: 829,340

[22] Filed: Aug. 31, 1977

[30] Foreign Application Priority Data

Sep. 21, 1976 [DE] Fed. Rep. of Germany ..... 2642444

[51] Int. Cl.[2] ..... B43L 13/02

[52] U.S. Cl. ..... 33/76 R

[58] Field of Search ..... 33/76, 79, 80, 112, 33/113, 114

[56] References Cited

U.S. PATENT DOCUMENTS

| | | | |
|---|---|---|---|
| 3,085,344 | 4/1963 | Tucker | 33/80 |

FOREIGN PATENT DOCUMENTS

| | | | |
|---|---|---|---|
| 1511459 | 9/1969 | Fed. Rep. of Germany | 33/79 R |
| 2107174 | 9/1972 | Fed. Rep. of Germany | 33/79 R |
| 224678 | 6/1943 | Switzerland | 33/168 B |
| 18817 of | 1914 | United Kingdom | 33/79 R |

*Primary Examiner*—Harry N. Haroian

*Attorney, Agent, or Firm*—Weingarten, Maxham & Schurgin

[57] ABSTRACT

A carriage drawing machine having a horizontal carriage driven along a horizontal slide rail support and carrying a vertical slide rail support. The vertical slide rail support and the horizontal carriage are coupled and are mutually tensioned by means of an interlocking mechanism.

8 Claims, 5 Drawing Figures

CARRIAGE DRAWING MACHINE

FIELD OF THE INVENTION

This invention relates generally to carriage drawing machines and more particularly concerns interlocking mechanism to positively couple the vertical slide rail support to the horizontal carriage.

DISCUSSION OF THE PRIOR ART

With known carriage drawing machines, the vertical sliding carriage support is screwed and additionally glued together with a support frame. The latter extends over the drawing board. At its rear end it is pivotably mounted on the horizontal carriage. In this way, the drawing machine can be flipped up from the drawing board. This connection between the vertical slide rail support and the support frame is expensive to manufacture. Nevertheless, this connection is unavoidably loosened somewhat under constant use, thus considerably impairing the accuracy of the drawing.

SUMMARY OF THE INVENTION

It is an object of this invention to avoid the above stated disadvantage and to create a connection between the horizontal carriage and the vertical slide rail support which connection guarantees a permanent, absolutely rigid tensioning.

A horizontal carriage is driven along a horizontal slide rail support and carries a vertical slide rail support. An interlocking mechanism provides mutual tensioning between the vertical slide rail support and the horizontal carriage to provide a positive coupling therebetween. This tensioning by means of an interlocking mechanism creates a connection through the intermeshing of the two parts. This connection is so solid that it can certainly not loosen unintentionally during running use.

BRIEF DESCRIPTION OF THE DRAWING

The objects, advantages and features of this invention will be easily understood from the following description when read in conjunction with the accompanying drawing in which.

DESCRIPTION OF THE PREFERRED EMBODIMENT

Figure 1:
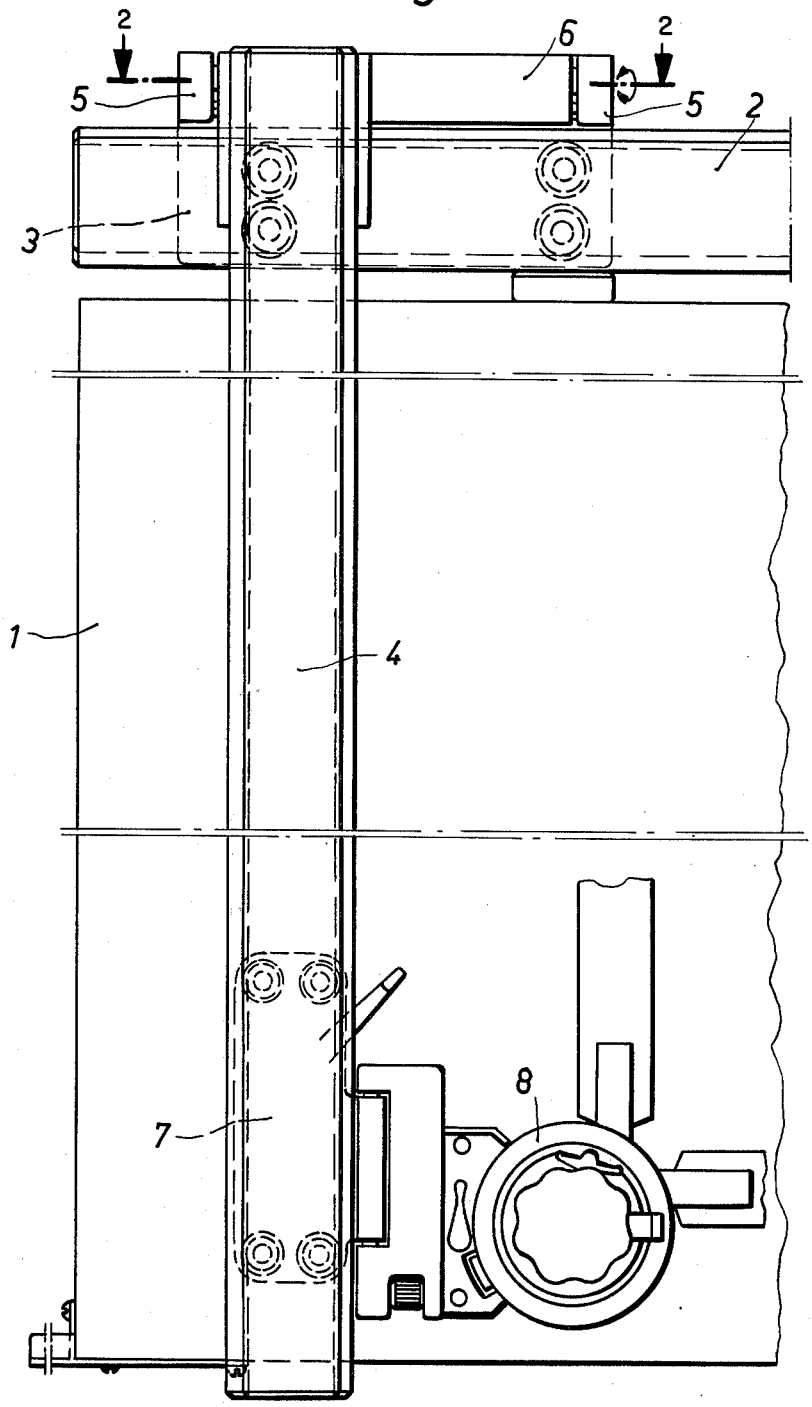
FIG. 1 is a partial top view of the carriage drawing machine of this invention mounted on a drawing board.

With reference now to the drawing and more particularly to FIG. 1 thereof, there is shown the carriage drawing machine of this invention wherein a horizontal slide rail support 2 is connected with a drawing board 1. A horizontal carriage 3 is guided along the slide rail support 2 and a support frame 6 is pivotably mounted in lateral projections 5 of the horizontal carriage 3. A vertical slide rail support 4 for a vertical carriage 7 is affixed to the support frame 6. The carriage 7 carries a drawing head 8.

Figure 2:
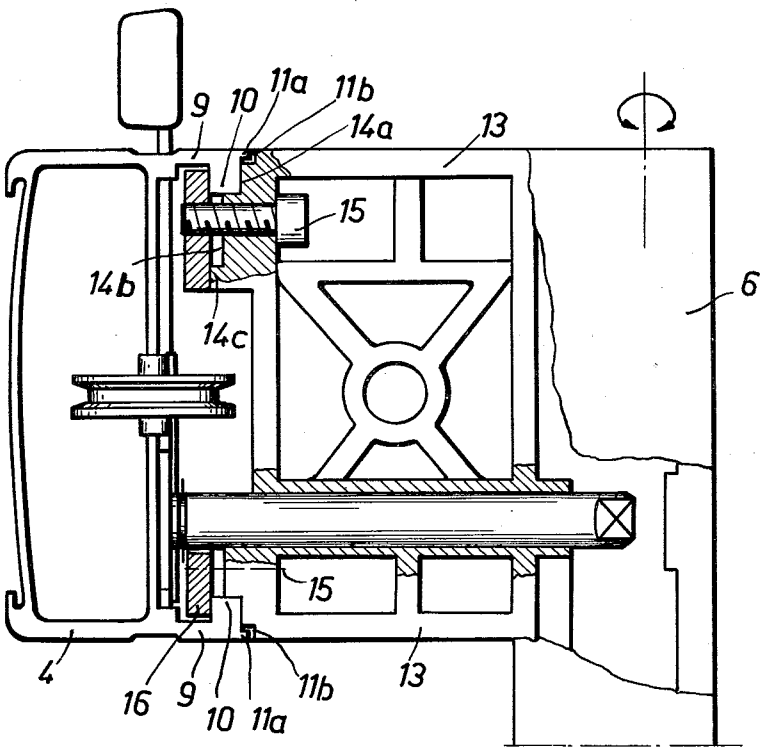
FIG. 2 is a partial sectional rear view of the support frame with the mounted vertical slide rail support taken along plane 2—2 of FIG. 1.
Figure 4:
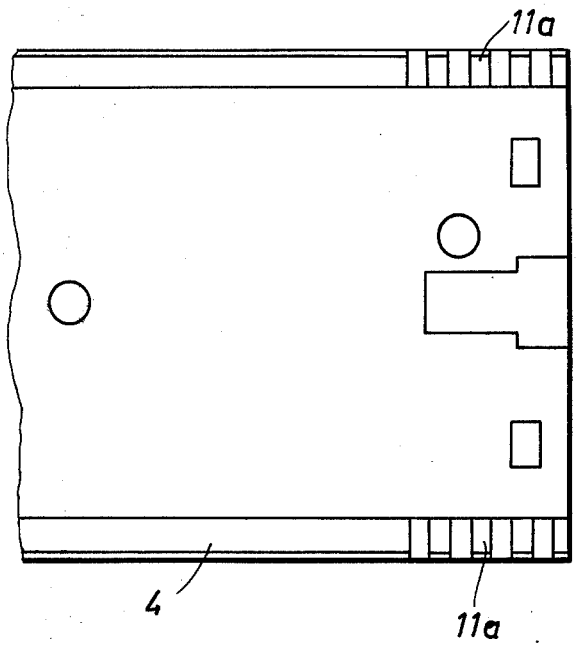
FIG. 4 is a fragmentary view of the rear side of the end piece of the vertical slide rail support.
Figure 5:
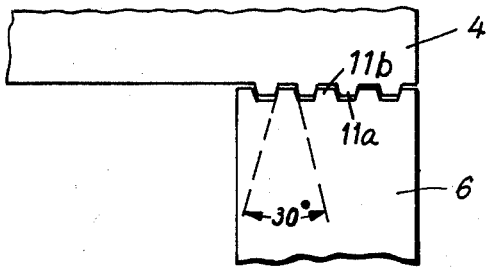
FIG. 5 is a is a fragmentary view showing the interlocked teeth

As is shown in FIG. 2, the vertical slide rail support 4 is formed with a hollow section. At the side facing the drawing board it has two brackets 9 with projections 10 extending inwardly. At the end edges of the brackets 9 in the area of the connection point with the support frame 6 is formed an interlock 11*a* in the form of teeth and grooves (see FIG. 4). The teeth of this interlock constrict from the fase of the tooth outward, whereby the flanks of each tooth enclose an angle of about 30° (FIG. 5). It has been determined that four interlocking teeth are sufficient to secure the connection.

Figure 3:
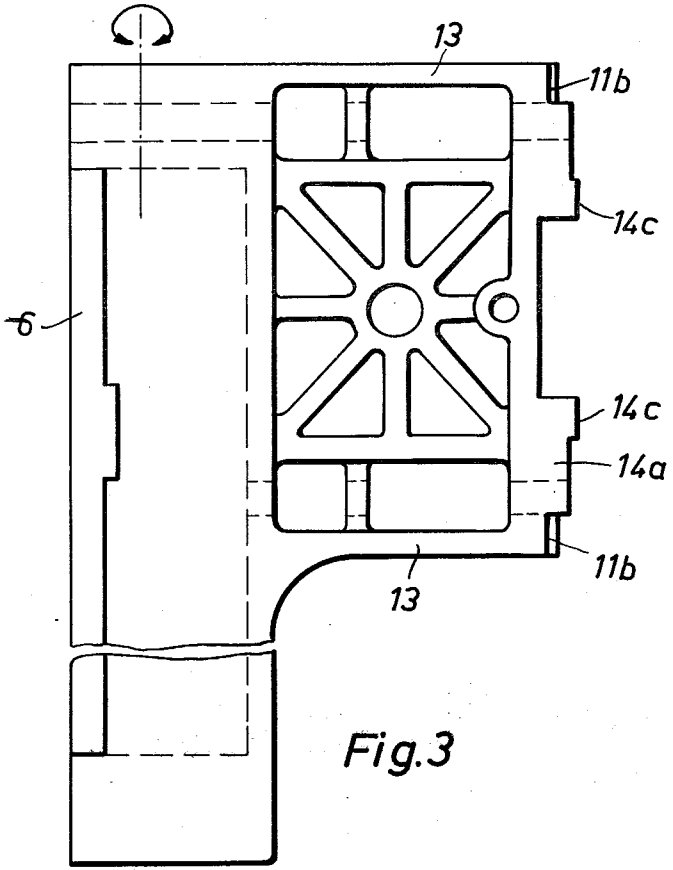
FIG. 3 is a top view of the support frame.

The corresponding counter-interlock element is provided in a forwardly protruding arm 13 of the support frame 6 as shown in FIGS. 2 and 3. The support frame 6 is pivotably mounted in the horizontal carriage 3 and the end surfaces of the support arms 13 point outward. These end surfaces are stepped and include fitting surfaces 14(*a*), 14(*b*) and 14(*c*), and an outermost portion which contains the interlock 11*b*. Its function is to accept the projections 10 of the brackets 9 of the vertical slide rail support 4. Proceeding further inwardly, there follows another surface 14*b* (FIG. 2) which again protrudes somewhat. The stepped fitting surface is terminated by a protruding strip 14*c* which serves as a support for a bracket 16. The design of the interlock 11*b* on the support arms 13 corresponds to the interlock 11*a* on the vertical slide rail support 4.

Screws 15 serve for mutual tensioning and they engage the brackets 16 shown in FIG. 2. Brackets 16 extend behind the projections 10 on vertical slide rail support 4. When the screws 15 are pulled tight, the interlocks 11*a* and 11*b* respectively are mutually tensioned on the slide rail support 4 and on the support frame 6, whereby the size of the teeth is mutually coordinated so that, even after a tight tensioning, there still remains some distance between the front surface of each tooth of one interlock and the corresponding tooth base of the other interlock.

In view of the above description, it is likely that modifications and improvements will occur to those skilled in the art which are within the scope of this invention.

What is claimed is:

1. In a carriage drawing machine having a horizontal slide rail support adapted for connection to a drawing board, a horizontal carriage slidably mounted on said horizontal slide rail support, a support frame pivotably mounted on said horizontal carriage for movement therewith, and a vertical slide rail support, an interlocking means coupling said support frame to said vertical slide rail support, said interlocking means comprising:

a first set of evenly spaced alternating teeth and grooves of similar size and shape protruding from a first surface on said support frame;

a second set of evenly spaced alternating teeth and grooves of a similar size and shape protruding from a second surface on said vertical slide rail support in juxtaposition with said first set of teeth and grooves to form a tight interlock with said first set of teeth and grooves; and variable tensioning means for securing together said first and second sets of teeth and grooves to thereby positively couple said vertical slide rail support to said support frame at said second surface and said first surface respectively.

2. The carriage drawing machine recited in claim 1 wherein said variable tensioning means comprises at least one bracket mounted on said vertical slide rail support, a tensioning support arm on said support frame for engaging said bracket, and a plurality of screws passing from said tensioning support arm to said bracket for securing said tensioning support arm to said bracket.

3. The carriage drawing machine recited in claim 1 wherein each of said first and second sets of teeth and grooves comprise four teeth and four grooves.

4. The carriage drawing machine recited in claim 1 wherein said first and second sets of teeth and grooves comprise teeth which are frusto-conical in cross section, the width of each of said first set of teeth being greatest on said first surface, and the width of each of said second set of teeth being greatest on said second surface.

5. The carriage drawing machine recited in claim 1 wherein said first and second sets of teeth and grooves are so coordinated with one another that after mutual tensioning, there still remains a distance between said first surface and said second set of teeth, and between said second surface and said first set of teeth.

6. The carriage drawing machine recited in claim 1 and further comprising members projecting from each side of said vertical slide rail support toward said support frame and having projections extending inwardly therefrom toward the center of said vertical slide rail support, said projections having said second surface formed thereon.

7. The carriage drawing machine recited in claim 1 wherein said support frame comprises outwardly extending support arms each having a fitting surface thereon, said fitting surface forming said tensioning support arm and said first surface and projecting relative to said first set of teeth.

8. The carriage drawing machine recited in claim 7 wherein said fitting surface is formed with mutually stepped end surfaces.

* * * * *